US005252790A

United States Patent [19]

Aime

[11] Patent Number: 5,252,790

[45] Date of Patent: Oct. 12, 1993

[54] METHOD AND APPARATUS FOR PROCESSING CALLS ENTERED IN ELEVATOR CARS

[75] Inventor: Michel Aime, Elancourt, France

[73] Assignee: Inventio AG, Hergiswil, Switzerland

[21] Appl. No.: 583,870

[22] Filed: Sep. 17, 1990

[30] Foreign Application Priority Data

Sep. 27, 1989 [CH] Switzerland ..... 3498/89

[51] Int. Cl.[5] ..... B66B 1/18

[52] U.S. Cl. ..... 187/127; 187/121

[58] Field of Search ..... 187/126, 127, 125, 121, 187/133; 364/513

[56] References Cited

U.S. PATENT DOCUMENTS

| | | | |
|---|---|---|---|
| 4,411,337 | 10/1983 | Schroder et al. | 187/127 |
| 4,555,000 | 11/1985 | Umeda . | |
| 4,655,325 | 4/1987 | Schröder et al. | 187/127 |
| 4,691,808 | 9/1987 | Nowak et al. . | |
| 4,760,896 | 8/1988 | Yamaguchi | 187/124 |
| 4,939,634 | 7/1990 | Schroder | 187/121 |
| 4,984,174 | 1/1991 | Yasunobu et al. | 364/513 |
| 4,989,694 | 2/1991 | Ueshima et al. | 187/121 |
| 4,991,694 | 2/1991 | Friedli | 187/127 |

FOREIGN PATENT DOCUMENTS 2141261 12/1984 United Kingdom .

*Primary Examiner*—Steven L. Stephan
*Assistant Examiner*—Robert Nappi
*Attorney, Agent, or Firm*—William J. Clemens

[57] ABSTRACT

In an elevator system with the immediate allocation of the floor calls, car calls are processed according to an algorithm implemented in a process computer. A preliminary processing of the car calls occurs upon entry of each of the car calls and a final processing occurs before the car call destination floor. A car call with a destination floor which coincides with the destination floor of an allocated call is allocated immediately during the preliminary processing. If there is no coincidence, the car call is shortened by one floor and registered. A car call registered during the preliminary processing is allocated with its original trip length during the final processing if there is coincidence with a destination floor of an allocated call. If no coincidence exists, the car call is allocated with a new destination floor which depends upon the allocated calls before and/or after the original car call destination floor.

16 Claims, 10 Drawing Sheets

Fig.2b

| | START | END | STATUS |
|---|---|---|---|
| | 2 | 4 | DFA |
| | 2 | 7 | DFA |
| | 2 | 8 | DFA |
| KR5 → | 2 | 4 | DCR |
| KR7 → | 2 | 7 | DCA |
| KR10 → | 2 | 9 | DCR |

1

Fig.3b

| | START | END | STATUS |
|---|---|---|---|
| | 2 | 4 | DFA |
| | 2 | 7 | DFA |
| | 2 | 8 | DFA |
| KR5 → | 2 | 4 | DCR |
| KR7 → | 2 | 7 | DCA |
| KR10 → | 2 | 9 | DCR |
| | 5 | 11 | DFA |
| KR5 → | 4 | 5 | DCA |

1

Fig.4b

| | START | END | STATUS |
|---|---|---|---|
| | 2 | 4 | DFA |
| | 2 | 7 | DFA |
| | 2 | 8 | DFA |
| KR5 → | 2 | 4 | DCR |
| KR7 → | 2 | 7 | DCA |
| KR10 → | 2 | 9 | DCR |
| | 5 | 11 | DFA |
| KR5 → | 4 | 5 | DCA |
| | 7 | 11 | DFA |
| KR10 → | 9 | 11 | DCA |

1

Fig.11

| | | | |
|---|---|---|---|
| S37 | INFO3 CREATE | XX : = DCC | |
| S38 | INFO3 GENERATE | | |
| S39 | PREPARE | STT : = CPO<br>DSN : = DCC<br>STS : = DCA | |
| S40 | TEST | STT/DSN/STS | GENERATE TO (1) |

Fig.12

| | | | |
|---|---|---|---|
| S41 | INFO2 CREATE | XX : = DCC<br>XY : = DCC OP3 1 | |
| S42 | INFO2 GENERATE | | |
| S43 | PREPARE | STT: = CPO<br>DSN: = DCC OP3 1<br>STS: = DCR | |
| S44 | TEST | STT/DSN/STS | GENERATE TO (1) |

METHOD AND APPARATUS FOR PROCESSING CALLS ENTERED IN ELEVATOR CARS

BACKGROUND OF THE INVENTION

The present invention relates generally to elevator system controls and, in particular, to an apparatus and a method for the processing of destination calls entered in elevator cars of an elevator group with immediate allocation of the calls entered at the floors.

A destination call control with floor call transmitters and car call transmitters for a plural elevator group is shown in U.S. Pat. No. 4,555,000. The floor call transmitters include destination buttons for registering the floor calls and the calls for the destination from the floor which calls are assigned to the cars. The allocated floor calls are indicated in the elevator cars. Calls entered in the cars are registered immediately and served without regard to the allocated floor calls. The disadvantage of this type of control is that the optimization of the elevator group performance capability, which is achieved by the immediate allocation of calls, is impaired by serving the car calls without regard to the allocated floor calls.

SUMMARY OF THE INVENTION

The present invention concerns a method and an apparatus for allocating car calls during the operation of an elevator group having the immediate allocation of floor calls. The advantages achieved by the present invention are chiefly that the redundancy in car carrying capacity arising from the immediate allocation of floor calls is utilized for allocating the car calls, that the allocation rates of the car calls will rise with higher traffic, and that coinciding allocated calls are promoted. Furthermore, elevator installations with the immediate allocation of calls become more friendly to passengers who have not entered calls in that an opportunity is afforded in the elevator car to the less practiced elevator users to remedy a failure to enter their floor destination without the remaining users in that case suffering a disadvantage.

In an elevator system with the immediate allocation of the floor calls, car calls are processed according to an algorithm implemented in a process computer. A preliminary processing of the car calls occurs upon entry of each of the car calls and a final processing occurs before the car call destination floor. A car call with a destination floor which coincides with the destination floor of an allocated call is allocated immediately during the preliminary processing. If there is no coincidence, the car call is shortened by one floor and registered. A car call registered during the preliminary processing is allocated with its original trip length during the final processing if there is coincidence with a destination floor of an allocated call. If no coincidence exists, the car call is allocated with a new destination floor which depends upon the allocated calls before and/or after the original car call destination floor.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIGS. 2*b*, 3*b* and 4*b* are each a tabular illustration of the elevator car trips shown in FIGS. 2*a*, 3*a* and 4*a* respectively;

FIG. 11 is a flow diagram of an algorithm for the processing of car calls in the case of coinciding allocated calls; and FIG. 12 is a flow diagram of an algorithm for the processing of car calls upon entry.

DESCRIPTION OF THE PREFERRED EMBODIMENT

For the sake of greater clarity, the names of the algorithms and the names of the devices shown in the FIGS. 1 to 5, as well as the abbreviations listed in the column "Memo-code" of the Table 1 below, are used as reference symbols in the following description of the present invention. In the FIGS. 6 to 9, method steps are illustrated in which tests are conducted as to whether constants, status variables or variables positively or negatively fulfil the conditions set forth in triangular areas. A positive result of a test is characterized by the reference symbol Y and a negative result of a test is characterized by the reference symbol N in the respective step.

TABLE 1

| Memo-code | Constant |
|---|---|
| INF00 | Call will not be served because of overload, please step out and enter call anew |
| INF01 | Call for floor EXX will not be served, please step out and enter call anew |
| INF02 | Call for floor EXX is processed in dependence on the allocated calls, further details follow on floor EXY |
| INF03 | Call for floor EXX will be served |
| DCA | Allocated car call |
| DCR | Registered car call |
| DFA | Allocated floor call |
| MLO | Maximum load |
| MSF | Maximum number of stops |
| | Status Variable |
| RDC | Direction of travel of car |

TABLE 1-continued

| Memo-code | Constant |
|---|---|
| RSC | Data offer by car |
| OP1 | Operator One |
| OP2 | Operator Two |
| OP3 | Operator Three |
| OP4 | Operator Four |
| | Variable |
| ASC | Allocation of car |
| CNT | Counter |
| CPO | Position of car |
| DCC | Destination call from car |
| DCF | Destination call of floor |
| DSN | Destination |
| EXX | Indicator One |
| EXY | Indicator Two |
| LOD | Last car |
| STF | Stopping floor |
| STS | Status |
| STT | Start |

Figure 1:
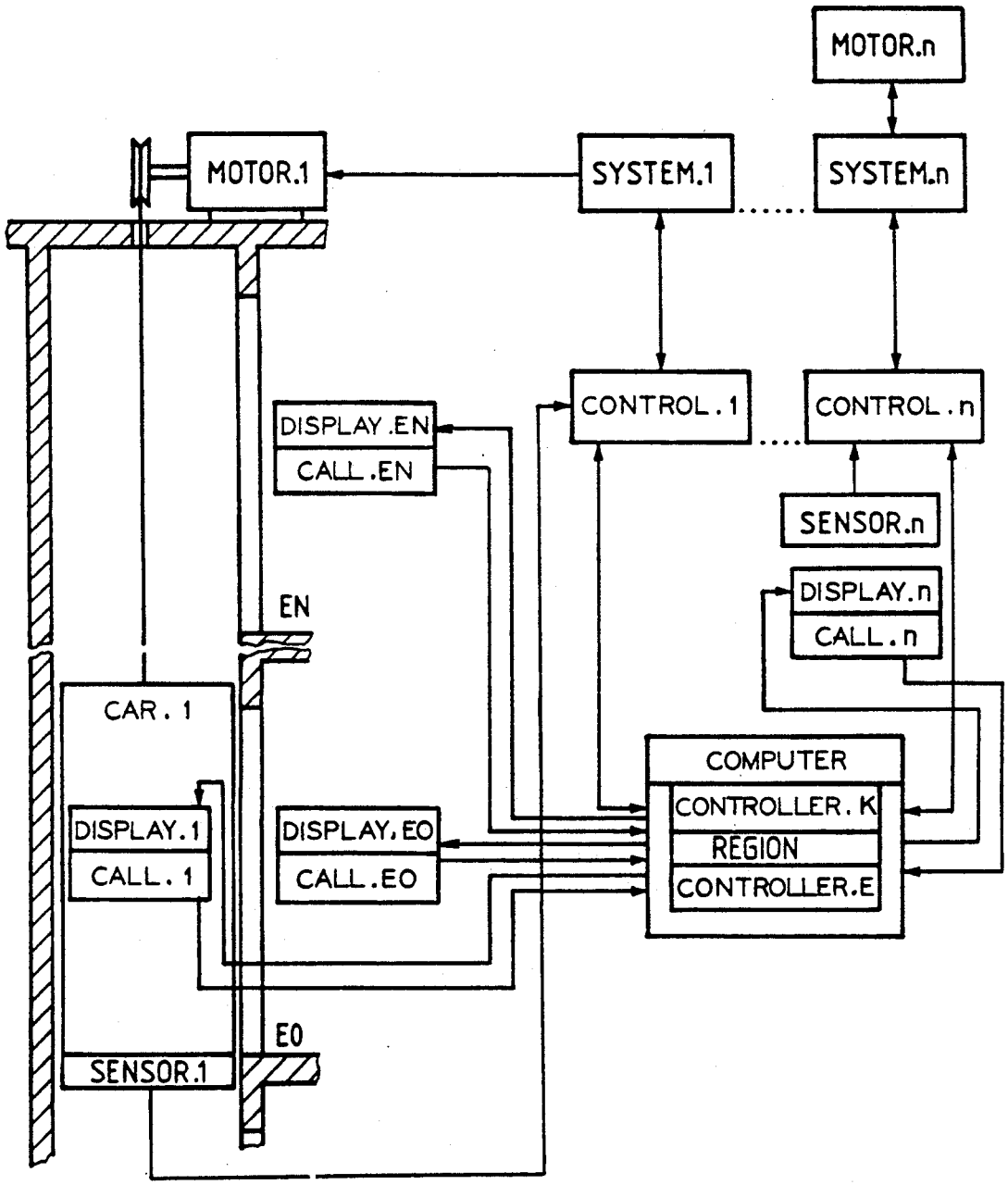
FIG. 1 is a partial schematic and partial block diagram of an elevator group control according to the present invention.

An elevator group, consisting of elevators designated "1" to "n" serving the floors EO to EN, is illustrated in the FIG. 1. Floor call registering devices CALL.EO to CALL.EN and floor call indicating devices DISPLAY.EO to DISPLAY.EN are provided on the floors EO to EN respectively. A hoist machine denoted by MOTOR.1 drives an elevator car CAR.1 of the elevator "1". The hoist machine MOTOR.1 is supplied with electrical energy by a drive system SYSTEM.1 which is controlled by an elevator control CONTROL.1. A load measuring device SENSOR.1, a car call registering device CALL.1 and a car call indicating device DISPLAY.1 are located in the elevator car CAR.1. The other elevators in the group are similar to the elevator "1" and are represented by the elevator "n" with a hoist machine MOTOR.n, a drive system SYSTEM.n, an elevator control CONTROL.n and an elevator car CAR.n (not shown) having a load measuring device SENSOR.n, a car call registering device CALL.n and a car call indicating device DISPLAY.n.

A process computer COMPUTER is connected with the floor call registering devices CALL.EO to CALL.EN, with the floor call indicating devices DISPLAY.EO to DISPLAY.EN, with the car call registering devices CALL.1 to CALL.n, with the car call indicating devices DISPLAY.1 to DISPLAY.n, with the sensors SENSOR.1 to SENSOR.n and with the elevator controls CONTROL.1 to CONTROL.n. An algorithm CONTROLLER.E implemented in the process computer COMPUTER controls the allocation of the destination calls entered on the floors EO to EN. An algorithm CONTROLLER.K also implemented in the process computer COMPUTER controls the processing of the destination calls entered in the elevator cars CAR.1 to CAR.n. Both algorithms have free access to a common memory area REGION in the process computer in which the allocated calls and other information is stored.

Figure 2A:
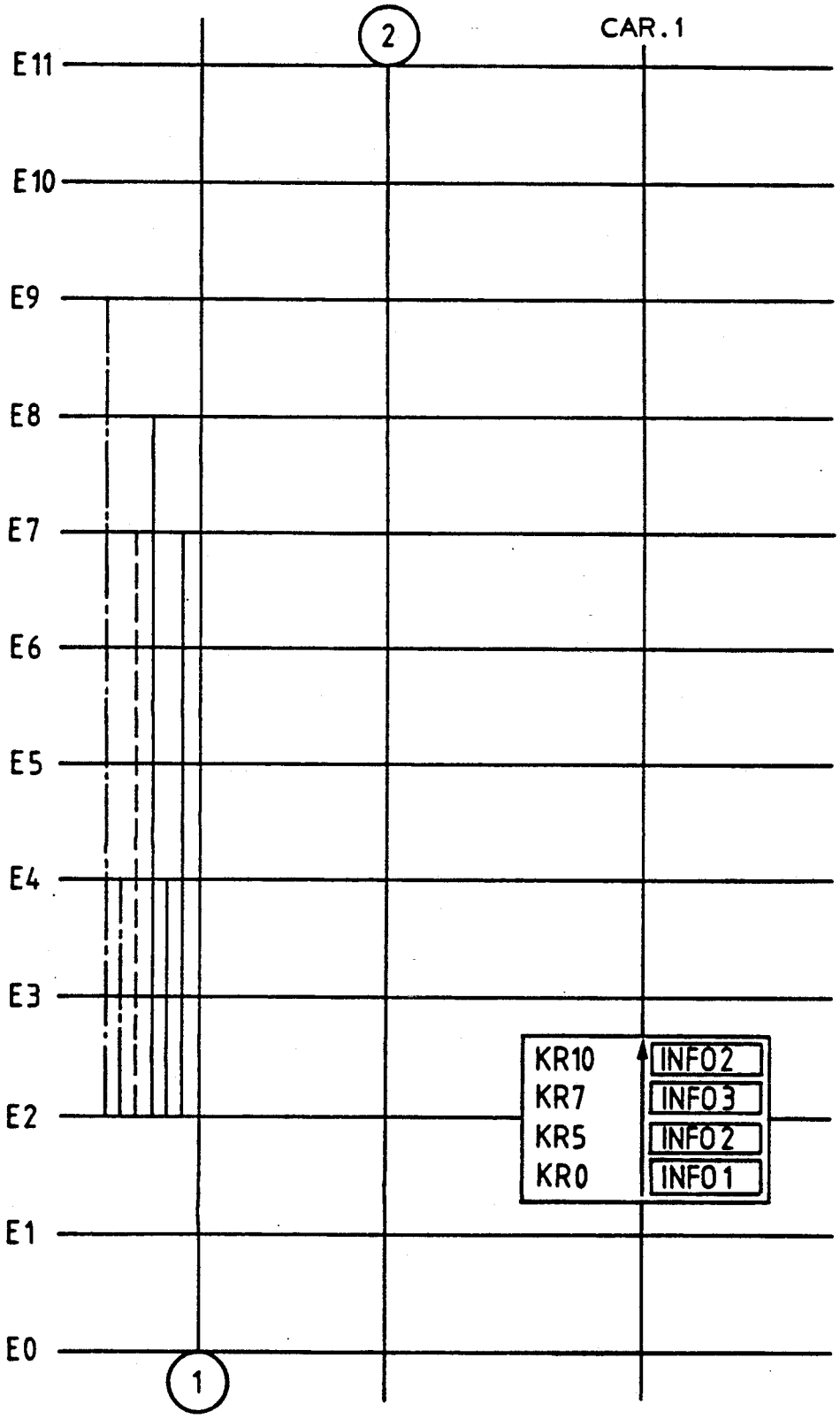
FIGS. 2*a*, 3*a* and 4*a* are schematic diagrams of the operation of the control of FIG. 1 utilizing the method according to the present invention.
Figure 3A:
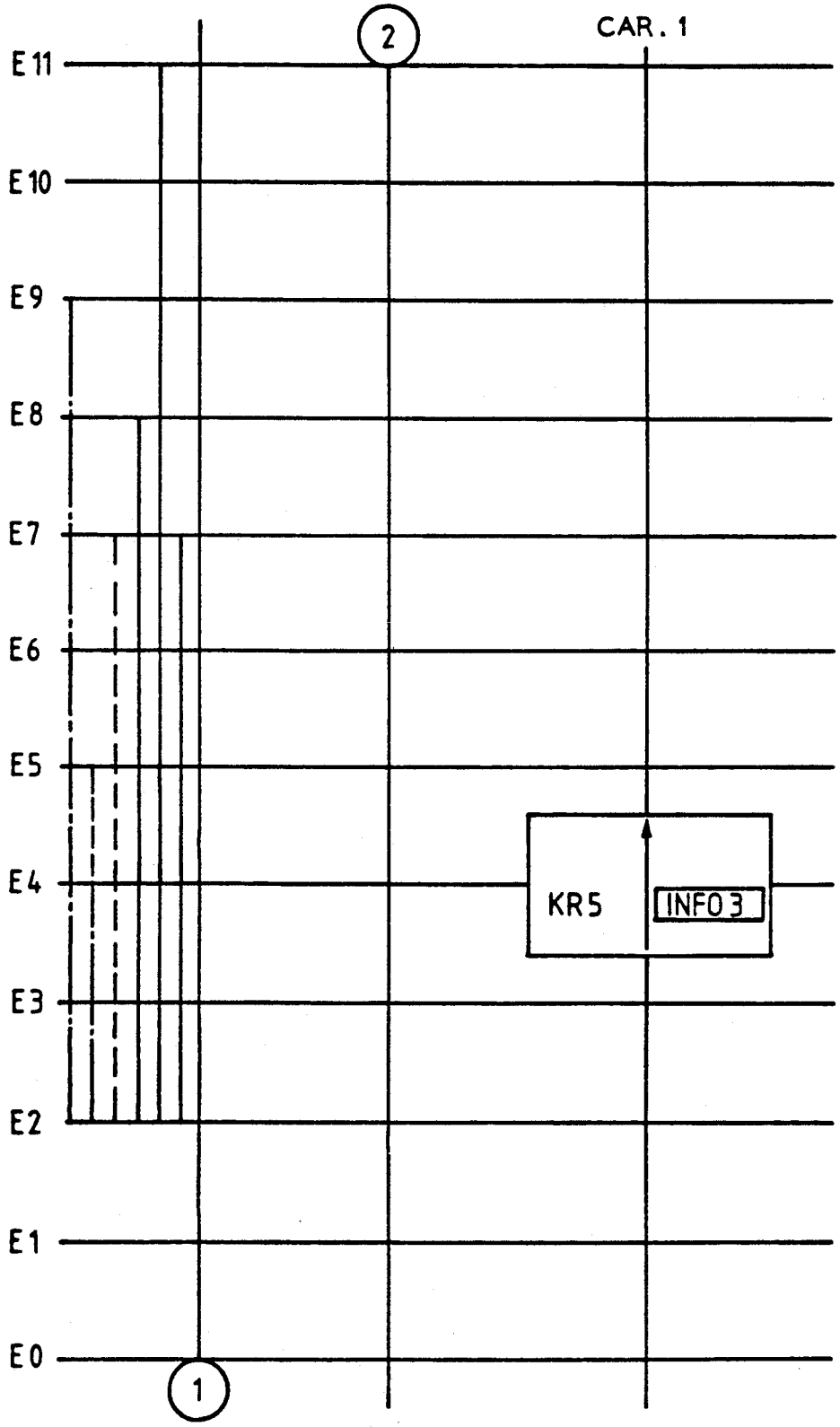
Figure 4A:
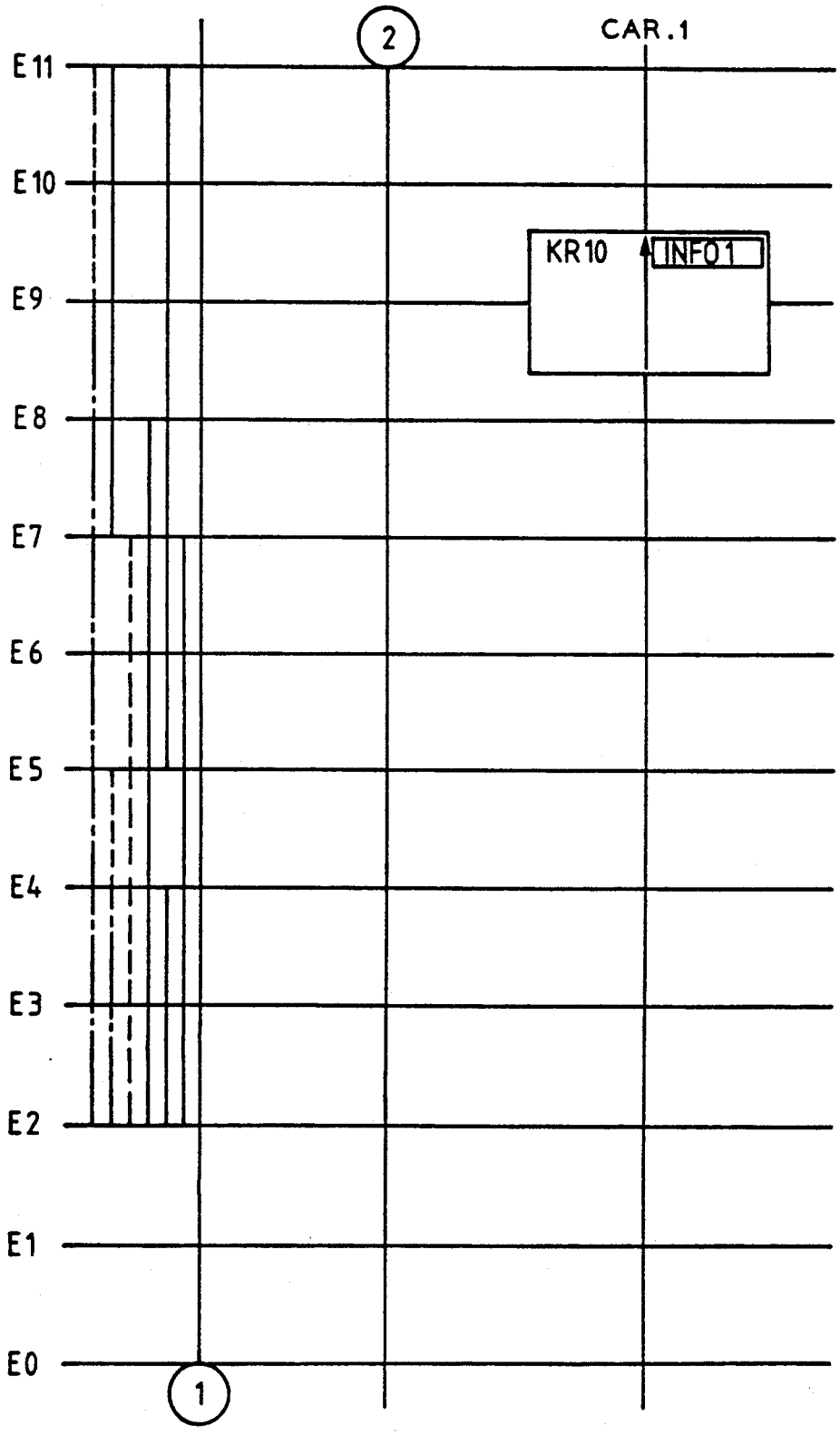

An example of the method according to the present invention, utilizing an elevator group with the floors EO to E11, is illustrated in the FIGS. 2*a*, 3*a* and 4*a*. The car calls KRO, KR5, KR7 and KR10 are entered in the elevator car CAR.1 on the floor E2. An upwardly pointing arrow symbolizes the direction of travel of the elevator car CAR.1. The number "1" framed by a circle designates a list in which the allocated destination calls of the current one half round trip are entered numerically as shown in the FIGS. 2*b*, 3*b* and 4*b*. The number "2" framed by a circle designates a list in which the allocated destination calls of the next one half round trip are entered numerically which list is not shown for the sake of simplicity. In the following, these reference symbols are referred to as Circle 1 and Circle 2 respectively. Allocated floor calls are illustrated by solid lines and allocated car calls by broken lines and registered car calls by chain dotted lines in the FIGS. 2*a*, 3*a* and 4*a*. These calls are entered numerically as trips in the list Circle 1 in the columns START/END shown in the FIGS. 2*b*, 3*b* and 4*b*. The kinds of calls are distinguished in the column STATUS by DFA, DCA and DCR, wherein an allocated floor destination call displays the status DFA, an allocated car destination call the status DCA and a registered car destination call displays the status DCR. At the end of the current one half round trip, the list Circle 1 is cleared of its contents and used for entries of the next one half round trip. At the same time, the list of trips Circle 2 is made into the list Circle 1 of the current one half round trip.

An example of the processing of car destination calls in dependence on the allocated destination calls is explained below with the aid of the FIGS. 2*a*, 2*b*, 3*a*, 3*b*, 4*a* and 4*b*. A floor call E2/E4, a floor call E2/E7 and a floor call E2/E8 are allocated, as shown in the FIG. 2*a*, to the upwardly travelling elevator car CAR.1 and entered in the list Circle 1 of the FIG. 2*b* as allocated trips in the columns START/END with the status DFA marked in the column STATUS. The car calls KRO, KR5, KR7 and KR10 are entered in the elevator car CAR.1 on floor E2. Car calls are processed only in case the car load ascertained by the load-measuring device SENSOR.1 does not exceed a predetermined limit value. In the case of overload, entered car calls are answered by a user information INFO0 with the text "call will not be served because of overload, please step out and enter call anew" on the indicating device DISPLAY.1. The car call KRO, lying behind the elevator car CAR.1 in the same direction of travel, is not served because no floor calls lying behind the car position are entered in the list Circle 1 of the current one half round trip.

Immediately upon the entry of the car call KRO, there is issued the user information INFO1 with the text "call for floor EO will not be served, please step out and enter call anew". The trip E2/E5, which has been requested by the car call KR5 and is illustrated graphically in the FIG. 2*a* by a chain dotted line, is entered in the list Circle 1 of the FIG. 2*b* as trip E2/E4 with the status DCR, since no allocated trip E2/E5 is present at this instant and the final treatment of KR5 takes place at the floor E4. Following the entry of the car call KR5, there is issued the user information INFO2 with the text "call for floor E5 is processed in dependence on the allocated calls, further details follow on floor E4".

For the car call KR7, a coincidence is present with the allocated trip E2/E7 entered in the list Circle 1. Due to this coincidence, the trip E2/E7, which has been requested by the car call KR7 and is illustrated in FIG. 2*a* by a broken line, is entered unconditionally into the list Circle 1 as an allocated trip characterized by the status DCA. Immediately upon the entry of the car call KR7, there is issued the user information INFO3 with the text "call for floor E7 will be served". The trip E2/E7, which has been requested by the car call KR10 and is illustrated graphically in the FIG. 2*a* by a chain dotted line, is entered into the list Circle 1 of the FIG. 2*b* as registered trip E2/E9 with the status DCR, since no allocated trip E2/E10 is present at this instant and the final treatment of KR10 takes place only at the floor E9. Immediately upon the entry of the car call KR10, there is issued the user information INFO2 with the text "call for floor E10 is processed in dependence on the allocated calls, further details follow on floor E9".

The traffic situation for the elevator car CAR.1 situated on the floor E4 is illustrated in the FIGS. 3*a* and 3*b*. A new trip E5/E11 has been allocated to the elevator car CAR.1 and entered into the list Circle 1 of the FIG. 3*b*. Now the final processing of the car call KR5 will be done. Through the newly allocated trip E5/E11, the floor E5 becomes a destination floor for the elevator car CAR.1, whereby the trip requested by the car call KR5 and hitherto registered as trip E2/E4 is prolonged into the trip E2/E5 entered in the list Circle 1 as from the floor E4 to the floor E5. The prolongation of the trip E2/E4 is effected by the entry of an allocated trip E4/E5, characterized by the status DCA, into the list Circle 1 of the current one half round trip. The newly allocated trip E4/E5 is illustrated in the FIG. 3*a* by a broken line. Following the entry of the car call KR5, there is issued the user information INFO3 on floor E4 with the text "call for floor E5 will be served".

The traffic situation for the elevator car CAR.1 situated on the floor E9 is illustrated in the FIGS. 4*a* and 4*b*. A trip E7/E11 newly allocated on the floor E7 to the elevator car CAR.1 is entered with the status DFA graphically in FIG. 4*a* and numerically in FIG. 4*b*. According to the instantaneous traffic situation, neither floor E9 nor floor E10 is an allocated start floor and/or end (destination) floor for the elevator car CAR.1 so that the elevator car CAR.1 travels past the floors E9 and E10 without stopping. The trip requested by the car call KR10 and hitherto registered as trip E2/E9 is prolonged from floor E9 to floor E11 into the trip E2/E11 entered into the list 1. The prolongation of the trip E2/E9 is effected by the entry of an allocated trip E9/E11, characterized by the status DCA, into the list of the current one half round trip. The newly allocated trip E9/E11 is illustrated by a broken line in the FIG. 4*a*. If the floor E9 had been an allocated start floor and/or end floor for the elevator car CAR.1, then the trip E2/E10 requested by the car call KR10 would have been terminated at the floor E9. Following the entry of the car call KR10, there is issued at the floor E9 the user information INFO1 with the text "call for floor E10 will not be served, please step out and enter call anew".

In the case of stationary elevator cars without allocated destination calls, the elevator doors remain closed, whereby the entry of car calls is intentionally prevented.

Figure 5:
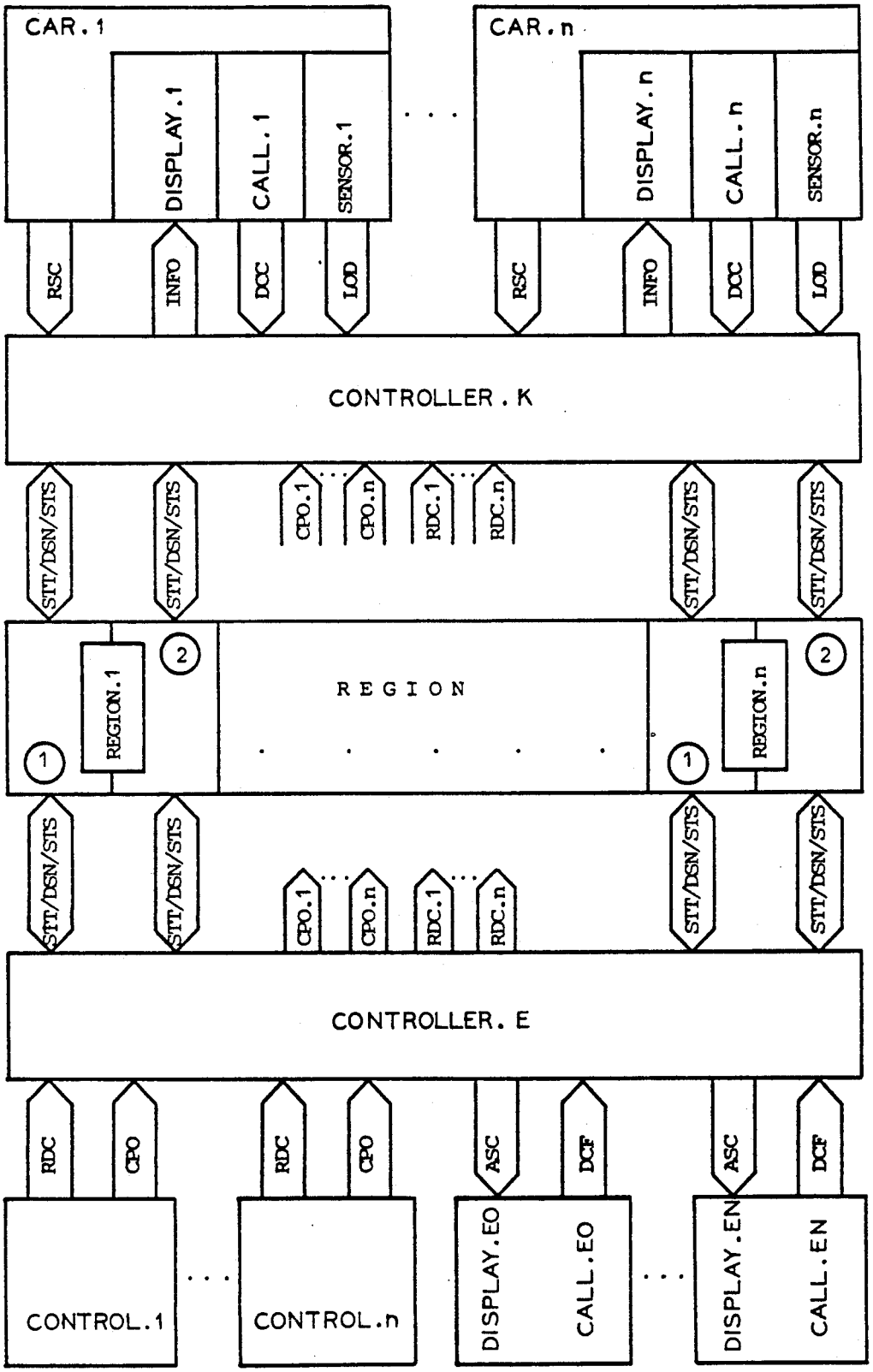
FIG. 5 is a block diagram of the data sources and data sinks utilized in the control of FIG. 1 and the method according to the present invention.

The data sources and data sinks participating in the process are illustrated in the FIG. 5. The algorithm CONTROLLER.E implemented in the process computer COMPUTER controls the allocation of the destination calls DCF entered by means of the floor call registering devices CALL.EO to CALL.EN on the floors EO to EN. Car allocations ASC are communicated to the users on the floors by means of the floor call display devices DISPLAY.EO to DISPLAY.EN and passed onto the elevator controls CONTROL.1 to CONTROL.n. Allocated destination calls are indicated in the elevator cars CAR.1 to CAR.n by means of equipment not illustrated. The elevator controls CONTROL.1 to CONTROL.n generate the directions of travel of the cars RDC and the car positions CPO according to the algorithm CONTROLLER.E.

The elevator cars CAR.1 to CAR.n generate the car loads LOD from the load measuring devices SENSOR.1 to SENSOR.n according to the algorithm CONTROLLER.K. The algorithm CONTROLLER.K, which controls the processing of the destination calls DCC entered in the elevator cars CAR.1 to CAR.n by means of the car call registering devices CALL.1 to CALL.n, receives the car positions CPO.1 to CPO.n and the directions of travel of the cars RDC.1 to RDC.n from the algorithm CONTROLLER.E. The algorithm CONTROLLER.K processes the car calls DDC independently of the received car travel directions RDC and of the received car positions CPO.

The data exchange between the elevator cars CAR.1 to CAR.n and the algorithm CONTROLLER.K is initiated by the status variables car data offers RSC. According to the type of processing of the car calls DCC, reports INFO1 to INFO3 are generated to the car call indicating devices DISPLAY.1 to DISPLAY.n. The common memory region REGION of the algorithms CONTROLLER.E and CONTROLLER.K is comprised of partial regions REGION.1 to REGION.n. The partial region REGION.1 is allocated to the elevator "1" and the partial region REGION.n is allocated to the elevator "n". For each partial region, there is provided a list Circle 1 and a list Circle 2 in which the allocated calls of the current one half round trip and the next one half round trip are entered in the form start/destination/status SST/DSN/STS. The lists are read or updated by the algorithm CONTROLLER.E as well as by the algorithm CONTROLLER.K. The algorithm CONTROLLER.E in addition takes over the control of the transfer from one list to the other list at the end of each half round so that the list of the next half round becomes the list of the current half round and the list of the current half round is cleared of its contents and becomes the list of the future next half round.

Figure 6:
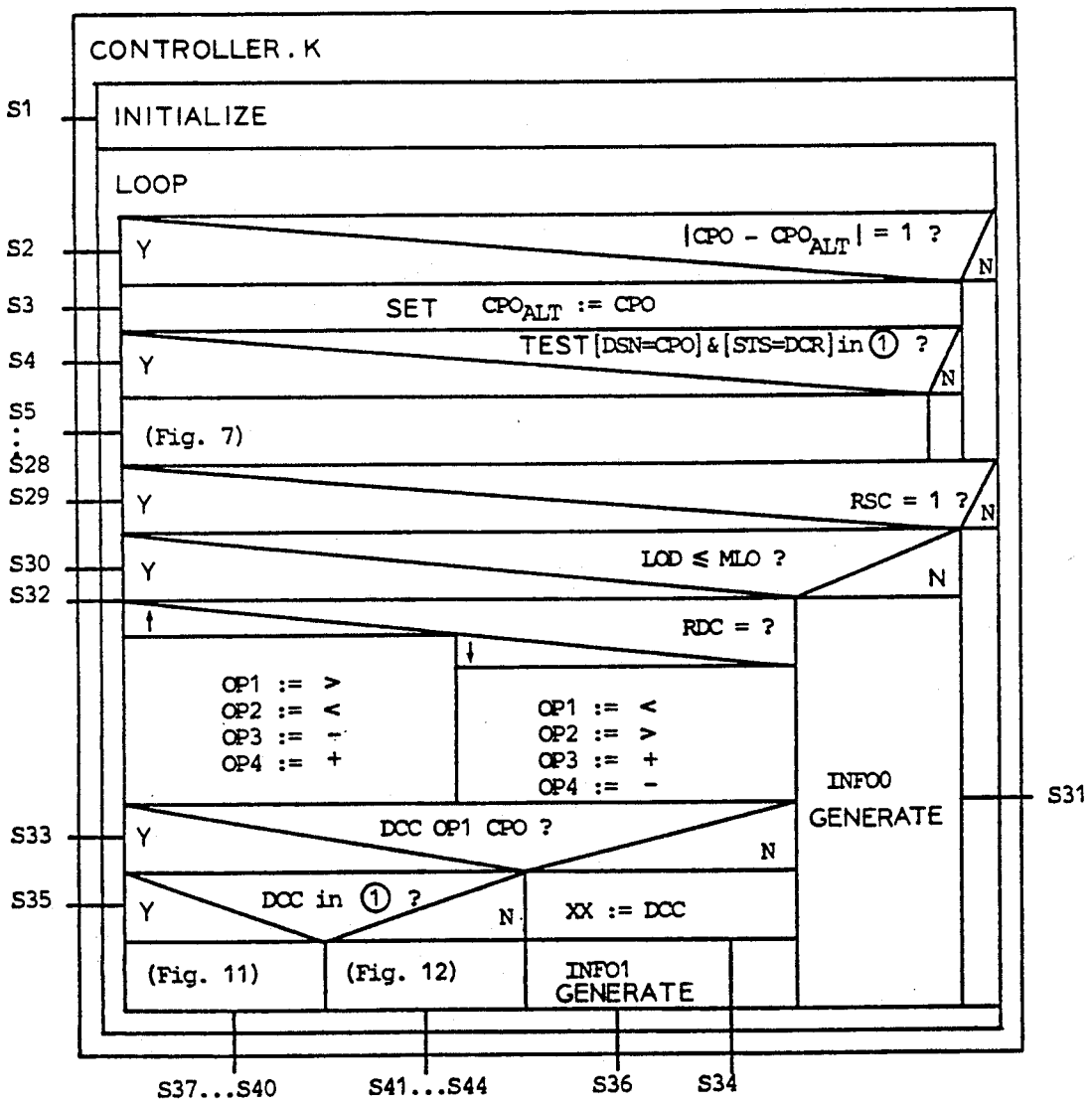
FIG. 6 is a flow diagram of an algorithm for the processing of car calls according to the present invention.

FIG. 6 shows the structure and the sequential course of the algorithm CONTROLLER.K. The process illustrated in the following steps relates to one elevator car and is identical for the remaining elevator cars. In a step S1, all constants and variables used in the algorithm CONTROLLER.K are brought into an initial state. In steps S2 to S28, the final processing of a car call takes place one floor before the destination floor associated with the car call. In steps S29 to S44, the processing of a car call takes place upon its entry. In a further variant of the present invention, the steps S2 to S28 are carried out by an algorithm CONTROLLER.K1 and the steps S29 to S44 by an algorithm CONTROLLER.K2, which algorithms, similar to the algorithm CONTROLLER.K, have free access to the common memory area REGION and have the capability of data exchange with the algorithm CONTROLLER.E.

In the step S2, the algorithm CONTROLLER.K tests whether the position of the elevator car CPO has changed. Upon a positive result of the test, the actual car position CPO is allocated in the step S3 to the old car position $CPO_{ALT}$. The allocation is indicated by the symbol ":=". In the step S4, the algorithm CONTROLLER.K searches in the list Circle 1 for registered calls having a data set with the destination DSN=CPO and with the status STS=DCR. The destination condition enclosed in square brackets is interlinked with the status condition enclosed in square brackets by way of an AND operator "&" so that a positive test result is present only when a registered car call destination with the value CPO is entered in the list Circle 1. Upon a positive result of the test in step S4, there follows the final processing of the registered car call as illustrated in the steps S5 to S28 of the FIGS. 7 to 10.

Upon a negative result in either of the tests in the steps S2 and S4, the step S29 is entered and the preliminary processing of a car call DCC is initiated. The status variable (data offer by car) RSC is tested to determine whether there are any car calls DCC to be processed. In the case of a positive test result, a testing step S30 for ascertaining an overload follows. The processing of the car call DCC is terminated in case the car load LOD exceeds a predetermined maximum load MLO and there follows the step S31 in which the user information INFO0 with the text "call will not be served because of overload, please step out and enter call anew" is generated to the car call indicating device of the elevator car. If the car is not overloaded, in the step S32, a selection procedure is carried out in dependence on the direction of travel RDC of the elevator car. In the case of an upward travel characterized by an upward arrow, the comparison operator ">" is allocated to the Operator One OP1, the comparison operator "<" is allocated to the Operator Two OP2, the sign operator "−" is allocated to the Operator Three OP3 and the sign operator "+" is allocated to the Operator Four OP4. In the case of downward travel characterized by a downward arrow, the operator allocation takes place in the appropriate opposite sense.

In the step S33, the algorithm CONTROLLER.K tests whether the car call DCC lies ahead of the elevator car as seen in the direction of travel. The direction of travel is determined by the comparison operator allocated to the Operator One OP1 in step S32. The processing of the car call DCC is terminated in case it lies behind the elevator car based upon the direction of travel. Thus, upon a negative result of the test in the step S33, the allocation of the floor EXX of the Indicator One takes place in the step S34 and the generation of the user information INFO1 with the text "call for floor EXX will not be served, please step out and enter call anew" takes place in the step S36. Upon a positive result of the test in the step S33, a further test takes place in the step S35 as to whether any destination calls coincident with the car call DCC have already been entered in the list Circle 1 of the current one half round trip. In case one or more such calls have been entered in the list Circle 1, the further processing of the car call DCC takes place in the steps S37 to S40 of the FIG. 11. Upon a negative result of the test in the step S35, the processing of the car call DCC is continued in the steps S41 to S44 of the FIG. 12.

Figure 7:
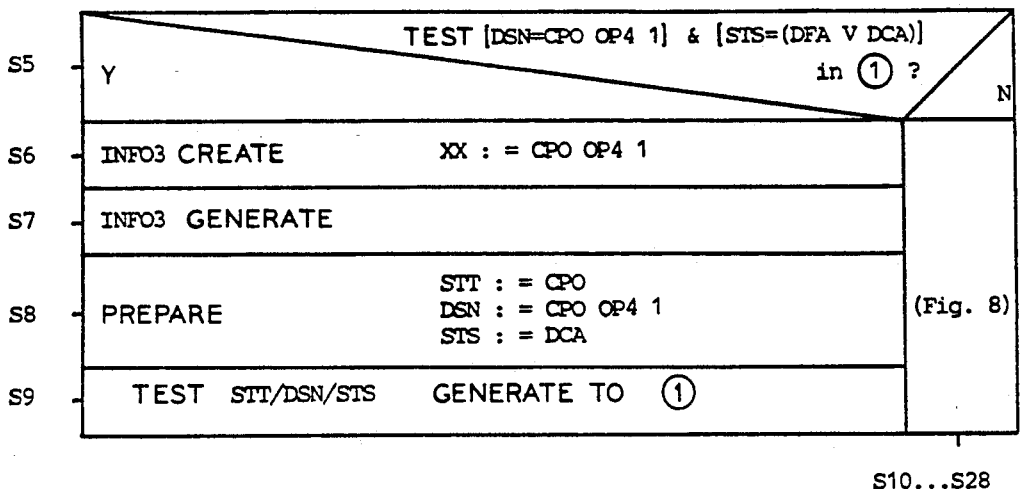
FIG. 7 is a flow diagram of an algorithm for the processing of car calls in the case of an allocated call at the car call destination floor.

FIG. 7 shows the structure and the sequential course of the algorithm CONTROLLER.K for the final processing of the registered car calls. A step S5 tests whether at least one call coincident with the car call destination DSN=CPO OP4 1 and with the status STS=(DFA V DCA) has been entered into the list Circle 1. In terms of the floor, the destination DSN lies one floor beyond the actual car position CPO. The destination condition enclosed in square brackets is interlinked with the status condition enclosed in square brackets by way of an AND operator "&". The status condition is fulfilled when an allocated floor call or an allocated car call is present. The "OR" interlinking is symbolized by an OR operator "V". In a further variant of the present invention, the algorithm CONTROLLER.K searches in the list Circle 1, not only for coincident destinations, but also for coincident starts of allocated calls.

Upon a positive result of the test in the step S5, the car call is prepared in the steps S6 to S9 for execution. The allocation of EXX of the Indicator One takes place in the step S6 and the generation of the user information INFO3 with the text "call for floor EXX will be served" takes place in the step S7. Subsequently, a data set with the variables STT :=CPO, DSN :=CPO OP4 1 and STS :=DCA is prepared in the step S8 and generated to the list Circle 1 in the step S9. This prolongation of the registered car call by one floor means that the trip requested by the original car call is entered in its entire length into the list Circle 1.

Figure 8:
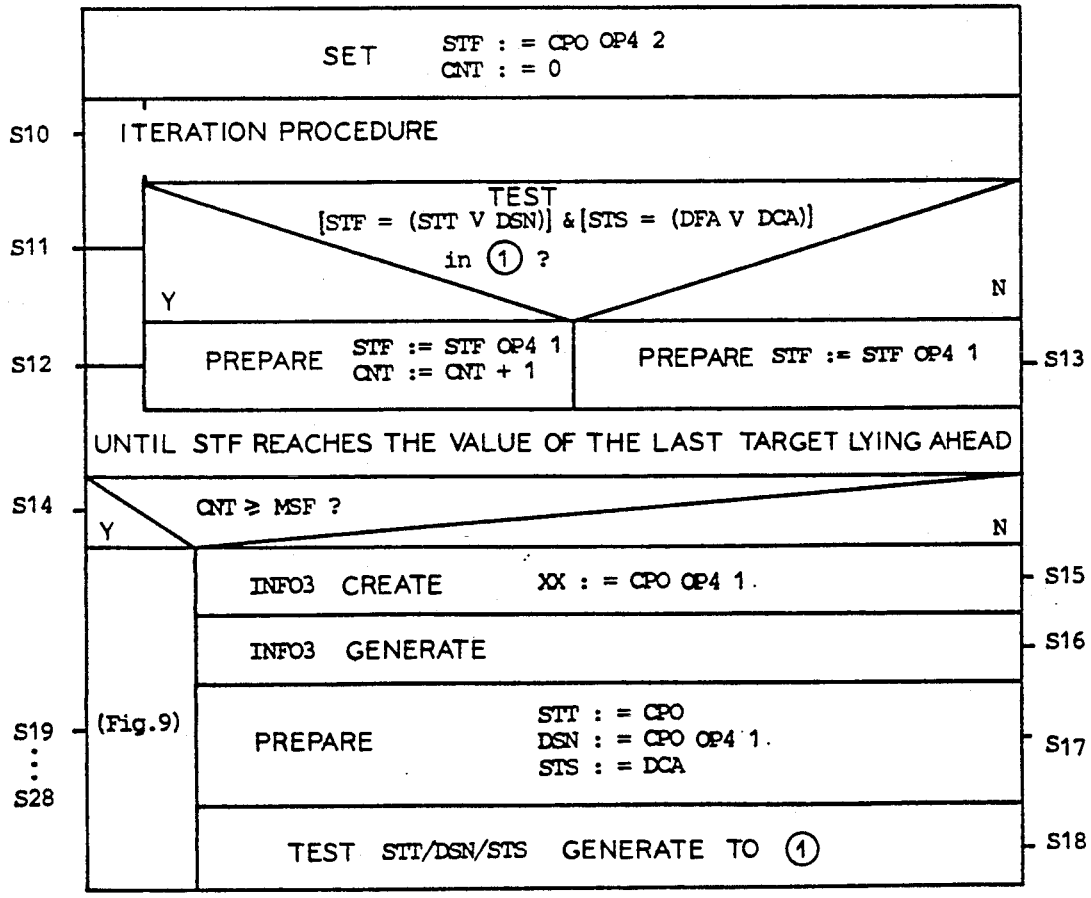
FIG. 8 is a flow diagram of an algorithm for the determination of the stopping floors behind the car call destination floor and for the processing of car calls in the case of a predetermined number of stopping floors lying ahead in the direction of travel.

If no allocated call for the car call floor is found in the list Circle 1 during the test in the step S5, the sequential course of the algorithm CONTROLLER.K is continued in the FIG. 8. An iteration procedure, which comprises the steps S11, S12 and S13, for the counting of the stopping floors lying beyond the car call destination floor is carried out in a step S10. In a value allocation preceding the step S10, the numerical value of the next floor lying beyond the car call floor is allocated to the stopping floor variable STF and the counter variable CNT is initialized. In a first pass through the iteration procedure, the algorithm CONTROLLER.K in a step S11 searches in the list Circle 1 for allocated calls with starts STT or destinations DSN coincident with the stopping floor STF. In case a call entered in the list Circle 1 is present with the destination condition and the status condition shown in the step S11, an incrementing of the stopping floor variable STF by one floor and an increase of the variable counter CNT by one take place in the step S12. In case no call entered in the list Circle 1 has the named conditions, the stopping floor STF is incremented further one floor in the step S12. The iteration procedure is run through repeatedly until the stopping floor variable STF has reached the value of the last destination DSN lying ahead of it. In a step S14, the stopping floors counted in the step S10 are compared with a maximum number of stopping floors NSF and, upon a negative result of the test, the steps S15 to S18 are initiated which steps are identical with the steps S6 to S9 described in the FIG. 7 for allocating the registered car call. In a further variant of the present invention, a cost calculation, which is composed of call costs, passenger costs and waiting costs, is applied in place of the stopping floor count shown in the steps S10 to S14 and, in the case the total costs do not exceed a predetermined value, the steps S15 to S18 are carried out.

Figure 9:
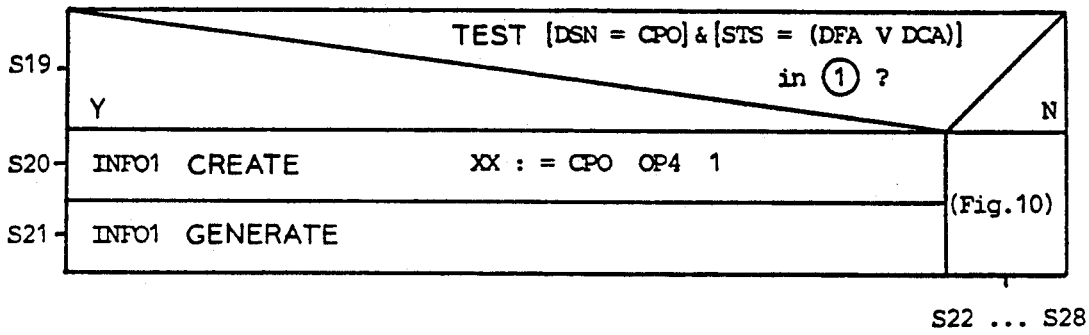
FIG. 9 is a flow diagram of an algorithm for the processing of car calls in the case of an allocated call at the car position.
Figure 10:
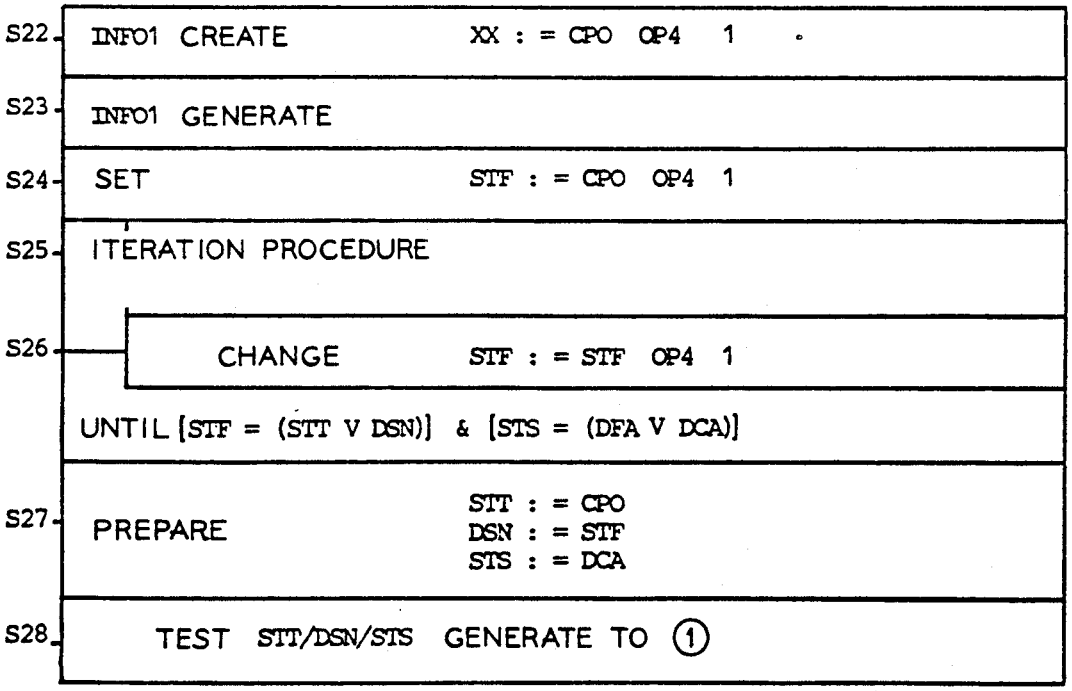
FIG. 10 is a flow diagram of an algorithm for the determination of the first stopping floor behind the car call destination floor and for the processing of car calls in dependence on the first stopping floor.

Upon a positive result of the test in the step S14, the sequential course of the algorithm CONTROLLER.K in the FIG. 9 is continued by a step S19 in which a call allocated to the actual car floor is searched for in the list Circle 1. Upon the positive result of the test in the step S19, there follows the allocation and the generation of the user information INFO1 with the text "call for floor EXX will not be served, please step out and enter call anew" in the steps S20 and S21. In case no call is allocated at the actual car floor, the first stopping floor lying behind the car call floor is searched for in the list Circle 1 according to FIG. 10. The user information INFO1 is provisionally allocated and generated in the steps S22 and S23. In the step S24, the preparation of the stopping floor variable STF takes place by allocating the numerical value of the car call floor. The steps S25 and S26 comprise an iteration procedure for the determination of the first stopping floor behind the car call floor. This iteration is run until a data set with the destination condition and the status condition shown in the step S26 is found in the list Circle 1. Subsequently, a data set with the variables STT :=CPO, DSN :=STF and STS :=DCA is prepared in the step S27 and generated to the list Circle 1 in a step S28. The extension of the registered car call to the first stopping floor lying ahead means that the trip requested by the original car call has been entered in its entire length into the list Circle 1.

FIGS. 11 and 12 show the structure and the sequential course of the algorithm CONTROLLER.K for the preliminary processing of the car calls. In the FIG. 11, a car call having an associated predetermined destination floor is allocated. In the FIG. 12, a car call not having an associated predetermined destination floor is registered. FIG. 11 shows the steps S37 to S40 wherein allocated calls coincident with the car call DCC have been entered in the list Circle 1. The allocation of EXX of the indicator one takes place in the step S37 and the generation of the user information INFO3 with the text "call for floor EXX will be served" takes place in the step S38. Subsequently, a data set with an allocated car call is prepared in step S39 and generated to the list Circle 1 in the step S40. FIG. 12 shows the steps S41 to S44 wherein no allocated calls coincident with the car call DCC are entered in the list Circle 1. The allocation of EXX and EXY of the indicator one takes place in the step S41 and the generation of the user information INFO2 with the text "call for floor EXX is processed in dependence on the allocated calls, further details follow on floor EXY" takes place in the step S42. Subsequently, a data set with a registered car call of the length DCC OP3 1 is prepared in the step S43 and generated to the list Circle 1 in the step S44.

In a further variant of the present invention, car calls lying behind the elevator car which cannot be served are allocated to the list Circle 2 in case the diversion by way of the last stopping floor does not exceed a predetermined number of floors.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for processing car calls for destination floors entered in elevator cars having elevator controls with the immediate allocation of floor calls entered on the floors served by the cars comprising the steps of:

a. performing a preliminary processing of each car call upon entry thereof in an elevator car by comparing an associated destination floor of each said car call with predetermined destination floors of allocated calls, allocating each said car call having an associated destination floor matching one said predetermined destination floor and registering each said car call not having an associated destination floor matching any said predetermined destination floor;

b. controlling the elevator car to travel to and stop at said predetermined destination floors; and c. performing a final processing of each said registered car call before the elevator car reaches a destination floor associated with said registered car call and allocating each said registered car call.

2. The method according to claim 1 wherein said preliminary processing includes comparing a destination floor for each said car call with a destination floor for each allocated call and, if a match is found, allocating said car call at once and, if a match is not found, changing a destination for said car call by reducing an associated trip length by one floor and registering said car call.

3. The method according to claim 1 including halting said preliminary processing if said car call initiates an overload condition in the elevator car.

4. The method according to claim 1 wherein said final processing includes comparing said destination floor for each said registered car call with said destination floor for each said allocated floor call and each said allocated car call and, if a match is found, allocating said registered car call with its original destination floor and, if no match is found, allocating said registered car call in dependence on one of said allocated floor and car calls having an associated destination floor behind or beyond said destination floor associated with said registered car call.

5. The method according to claim 4 including, if no match is found, allocating said registered car call with its original destination floor for up to a predetermined number of said allocated calls having an associated starting floor or an associated destination floor beyond said destination floor associated with said registered car call.

6. The method according to claim 5 including, if no match is found and said predetermined number is equalled or exceeded, allocating said registered car call with a shortened trip length having a new destination floor.

7. The method according to claim 5 including, if no match is found and said predetermined number is equalled or exceeded, allocating said registered car call with an extended trip length having a new destination floor at a first stopping floor beyond an original associated destination floor of said registered car call.

8. The method according to claim 1 including generating reports on the state of said preliminary and said final processing to operators.

9. A method for processing car calls for destination floors entered in elevator cars having elevator controls with the immediate allocation of floor calls entered on the floors served by the cars comprising the steps of:

a. performing a preliminary processing of each car call upon entry thereof in an elevator car by comparing an associated destination floor of each said car call with predetermined destination floors of allocated calls, allocating said car call if an associated destination floor matches said predetermined destination floor associated with a previously allocated call and registering said car call if said associated destination floor does not match any said predetermined destination floor associated with said previously allocated call;

b. controlling the elevator car to travel to and stop at said predetermined destination floors; and c. performing a final processing of any car call registered during said preliminary processing before the elevator car reaches said associated destination floor.

10. An apparatus for processing destination calls entered in call registering devices located in elevator cars of an elevator group, the cars having elevator controls with immediate allocation of destination calls entered on the floors served by the cars, comprising:

a process computer connected to car call registering devices located in elevator cars and floor call registering devices located at floors served by the elevator cars of an elevator group and having a memory means for storing allocated floor and car calls;

comparator means in said process computer for comparing a destination floor associated with a car call entered in an elevator car with destination floors associated with floor and car calls previously allocated to the elevator car;

preliminary processing means in said process computer connected to said memory means and to said comparator means and responsive to entry of said car call for storing said car call as an allocated car call in said memory means when said comparator means indicates a destination floor match and for storing said car call as a registered car call in said memory means if no destination floor match is present;

control means connected to said memory means for controlling the elevator car to travel to and stop at said destination floors associated with said allocated floor and car calls; and final processing means in said process computer connected to said memory means and to said comparator means and responsive to the arrival of the elevator car one floor before the destination floor for said registered car call for storing said registered car call as an allocated car call in said memory means when said comparator means indicates a destination floor match and for storing said registered car call as an allocated car call in said memory means with a different destination floor if no destination floor match is present.

11. The apparatus according to claim 10 wherein said preliminary processing means includes means for changing the destination floor for said registered car call by reducing an associated trip length by one floor before said registered car call is stored.

12. The apparatus according to claim 10 wherein said final processing means includes means for allocating said registered car call with its original destination floor if a match is found and, if no match is found, allocating said registered car call in dependence on one of said allocated floor and car calls having an associated destination floor behind or beyond said destination floor associated with said registered car call.

13. The apparatus according to claim 12 wherein said final processing means includes means for counting the number of said allocated calls having an associated starting floor or an associated destination floor beyond said destination floor associated with said registered car call and, if no match is found and said number is less than a predetermined number, storing said registered car call with its original destination floor as an allocated car call.

14. The apparatus according to claim 13 wherein said final processing means includes means for storing said registered car call as an allocated car call with a shortened trip length having a new destination floor if no match is found and said predetermined number is equalled or exceeded.

15. The apparatus according to claim 13 wherein said final processing means stores said registered car call as an allocated car call with an extended trip length having a new destination floor at a first stopping floor beyond an original associated destination floor of said registered car call if no match is found and said predetermined number is equalled or exceeded.

16. An apparatus for processing destination calls entered in call registering devices located in elevator cars of an elevator group, the cars having elevator controls with immediate allocation of destination calls entered on the floors served by the cars, comprising:

floor call registering devices located at floors served by elevator cars of an elevator group for entering floor calls;

car call registering devices located in each of the elevator cars for entering car calls;

a process computer connected to said floor call registering devices and to said car call registering devices for allocating entered floor calls and car calls to the elevator cars and including memory means for storing said allocated floor and car calls;

said process computer including preliminary processing means for comparing a destination floor associated with an entered car call with a destination floor associated with each said allocated floor and car call stored for the elevator car in which said car call was entered, said process computer storing said car call as an allocated car call when a match is found and storing said car call as a registered car call when a match is not found;

control means connected to said memory means for controlling the elevator car to travel to and stop at said destination floors associated with said allocated floor and car calls; and said process computer including final processing means for comparing said destination floor associated with said registered car call with a destination floor associated with each said allocated floor and car call before the elevator car reaches said destination floor associated with said registered car call, said computer storing in said memory means said registered car call as an allocated car call when a match is found and storing said registered car call as an allocated car call with a different destination floor when a match is not found.

* * * * *